US005704438A

United States Patent [19]

Kloppers et al.

[11] Patent Number: 5,704,438

[45] Date of Patent: Jan. 6, 1998

[54] ROTARY BORER

[75] Inventors: Stephanus F. Kloppers, Postmasburg; Richard G. Holtshausen, Lynnwood Glen; Noel G. Wright, The Reeds, all of South Africa

[73] Assignees: Kennametal Inc., Latrobe, Pa.; Kennametal South Africa (Proprietary) Limited, South Africa

[21] Appl. No.: 732,244

[22] PCT Filed: May 2, 1995

[86] PCT No.: PCT/US95/05401

§ 371 Date: Oct. 25, 1996

§ 102(e) Date: Oct. 25, 1996

[87] PCT Pub. No.: WO95/30066

PCT Pub. Date: Nov. 9, 1995

[30] Foreign Application Priority Data

May 3, 1994 [ZA] South Africa ..... 94/3040

[51] Int. Cl.[6] ..... E21B 10/40

[52] U.S. Cl. ..... 175/420.1; 175/431; 175/432

[58] Field of Search ..... 175/420.1, 426, 175/428, 431, 432

[56] References Cited

U.S. PATENT DOCUMENTS

| | | | |
|---|---|---|---|
| 4,026,372 | 5/1977 | Hampson | 175/420.1 |
| 5,172,775 | 12/1992 | Sheirer et al. | 175/420.1 X |
| 5,184,689 | 2/1993 | Sheirer et al. | 175/420.1 |
| 5,220,967 | 6/1993 | Monyak | 175/432 X |

*Primary Examiner*—Roger J. Schoeppel
*Attorney, Agent, or Firm*—John J. Prizzi

[57] ABSTRACT

A rotary borer has a body (10) mountable on a drill steel and one or more cutting tips (30) at a front of the body (10). Each tip (30) is tapered and is frictionally received in a corresponding tapered slot (22) in the body (10). The slot (22) has a trailing, rigid anvil surface (16), which extends almost to the extremity of the tip (30) to support the tip (30) and to locate it laterally, and a leading, resilient retaining surface (20) well shy of the extremity of the tip (30) to expose a portion of the tip. The tip (30) is readily replaceable. Release of the tip can be effected by heat or by means of taper drift (38) for which a transverse hole (37) is provided proximate a bottom of the slot (22).

10 Claims, 3 Drawing Sheets

ROTARY BORER

BACKGROUND OF THE INVENTION

This invention relates to a rotary borer of the kind comprising a body having mounting means for mounting it on a drill steel, and carrying one or more cutting tips of a hard, abrasion resistant material, which tips are arranged to cut into rock or rock-like substrate in use.

It relates further to a method of releasing such a tip from such a body.

The Applicant believes that this invention will find application particularly in the field of borers for use in coal mining operations. For purposes of this specification, that application will predominantly be borne in mind, but the invention is not limited to that application. In coal mining, a coal seam is mined by means of continuous miners leaving a void between a hanging wall and a foot wall. To prevent the hanging wall from collapsing, deep holes are bored into the hanging wall and roof bolts are anchored in the holes to allow support structure to be suspended from the roof bolts. The Applicant believes that a borer in accordance with this invention can advantageously be used in the drilling of such deep holes.

SUMMARY OF THE INVENTION

In accordance with a first aspect of this invention, there is provided a rotary borer including a body which is generally round having a rotation axis, a front and a rear, the body comprising drill steel mounting means for releasably mounting the borer on a drill steel to be rotated in a predetermined rotary direction about the rotation axis in use, and tip mounting means including an anvil formation defining a forwardly extending anvil surface and an opposing retaining formation defining a forwardly extending retaining surface, the anvil surface and retaining surface being forwardly diverging to form between them a correspondingly forwardly extending slot which slot tapers rearwardly at an angle smaller than about 5°; and a tip of hard, abrasion-resistant material having a front, a rear and sides tapering toward the rear at an angle which is complemental to the angle of the slot, the tip being operatively received in the slot such that pressure on the tip during boring, in a longitudinal direction opposite to the direction in which boring advances, wedges the tip into the slot to cause frictional retention of the tip in the slot, wherein the anvil surface, relative to the predetermined direction of rotation in use, is arranged to trail the tip, the anvil surface having a non-planar seat to seat the tip which has a complemental seat formation, the anvil surface extending forwardly to a position at most a small distance short of the forward extremity of the tip to support the tip along a major portion of its length, the retaining formation terminating longitudinally short of the forward extremity of the anvil surface and well short of the forward extremity of the tip to leave a relatively long portion of the tip toward its front exposed.

The taper angle may be between about 1° and about 3°, preferably about 2°.

In a preferred embodiment, said tip mounting means may be first tip mounting means disposed generally radially toward one side of the rotary axis and in which said tip may be a first tip, the borer including second tip mounting means circumferentially spaced from the first tip mounting means and a second tip similarly received in the second tip mounting means. The borer may be symmetrical about the rotation axis. The first and second tip mounting means may be identical and the first and second tips may be identical. The first and second tips may be radially aligned.

In one embodiment, the tips may have peaks or forward extremities toward their radially inner ends. If desired, the first and second tips may be integral to form a composite tip. This embodiment may be particularly useful in so called "dry drilling" application, i.e. when drilling is effected without water as a lubricant or flushing medium.

In another embodiment, the first tip may have a peak or forward extremity toward a radially inner end and the second tip may have a peak or forward extremity toward a radially outer end.

In one kind of embodiment, there may be provided an aperture through the body which aperture is transverse to the slot and open to a rear or bottom of the slot such as to allow a thin end of a taper drift to he inserted underneath a rear end of the tip and to wedge the tip out of the slot by progressive penetration of the taper drift into the aperture. Thus, the tip can be released from the body by tapping or driving a taper drift into the aperture.

In accordance with a second aspect of this invention, there is provided a rotary borer including a body which is generally round having a rotation axis, a front and a rear, the body comprising drill steel mounting means for releasably mounting the borer on a drill steel to be rotated in a predetermined rotary direction about the rotation axis in use, and tip mounting means including an anvil formation defining a forwardly extending anvil surface and an opposing retaining formation defining a forwardly extending retaining surface, the anvil surface and retaining surface being forwardly diverging to form between them a correspondingly forwardly extending slot which slot tapers rearwardly at an angle smaller than about 5°; and a tip of hard, abrasion-resistant material having a front, a rear and sides tapering toward the rear at an angle which is complemental to the angle of the slot, the tip being operatively received in the slot such that pressure on the tip during boring, in a longitudinal direction opposite to the direction in which boring advances, wedges the tip into the slot to cause frictional retention of the tip in the slot, wherein the anvil surface, relative to the predetermined direction of rotation in use, is arranged to trail the tip, one of the anvil surface and the retaining surface having a non-planar seat to seat the tip which has a complemental seat formation, in which the anvil formation has a relatively thick cross section and is correspondingly relatively rigid and the retaining formation has a relatively thin cross section and is correspondingly relatively resilient.

In accordance with a third aspect of this invention, in a rotary borer including a body which is generally round having a rotation axis, a front and a rear, the body comprising drill steel mounting means for releasably mounting the borer on a drill steel to be rotated in a predetermined rotary direction about the rotation axis in use, and tip mounting means including an anvil formation defining a forwardly extending anvil surface and an opposing retaining formation defining a forwardly extending retaining surface, the anvil surface and retaining surface being forwardly diverging to form between them a correspondingly forwardly extending slot which slot tapers rearwardly at an angle smaller than about 5°; and a tip of hard, abrasion-resistant material having a front, a rear and sides tapering toward the rear at an angle which is complemental to the angle of the slot, the tip being operatively received in the slot such that pressure on the tip during boring, in a longitudinal direction opposite to the direction in which boring advances, wedges the tip into the slot to cause frictional retention of the tip in the slot, wherein the anvil surface, relative to the predetermined direction of rotation in use, is arranged to trail the tip, the anvil surface having a non-planar seat to seat the tip which has a complemental seat formation, the anvil surface extending forwardly substantially to the forward extremity of the tip substantially fully to support the tip, the retaining formation terminating longitudinally short of the forward extremity of the tip to leave a portion of the tip toward its front exposed, the retaining formation, relative to the anvil formation, being of thinner cross-section and more resilient, there is provided a method of releasing the tip from the body, the method including applying heat to the retaining formation to cause the retaining formation to deform to open the slot.

Thus, advantageously, the tip may be released to allow replacement in situ.

BRIEF DESCRIPTION OF THE DRAWINGS

The invention is now described by way of examples with reference to the accompnaying diagrammatic drawings.

In the drawings

DETAILED DESCRIPTION

Figure 1:
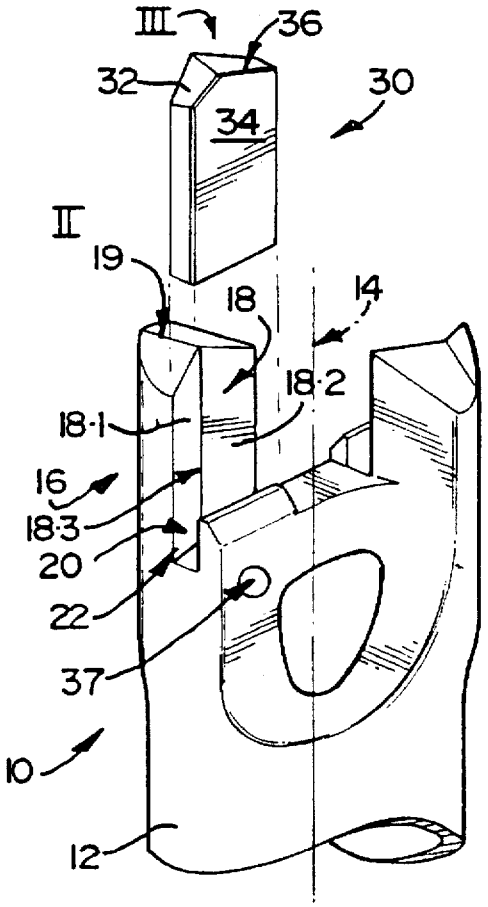
FIG. 1 shows, in three dimensional side view, a first embodiment of a rotary borer body and a tip in accordance with this invention.
Figure 2:
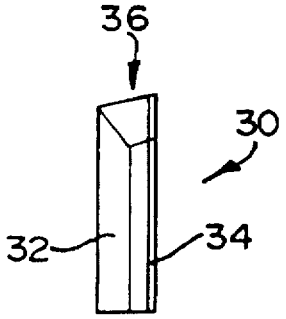
FIGS. 2 and 3 show the tip of FIG. 1 respectively in end view in accordance with arrow II, and in plan view in accordance with arrow III.
Figure 3:
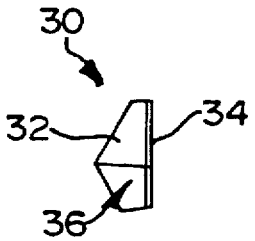
Figure 4:
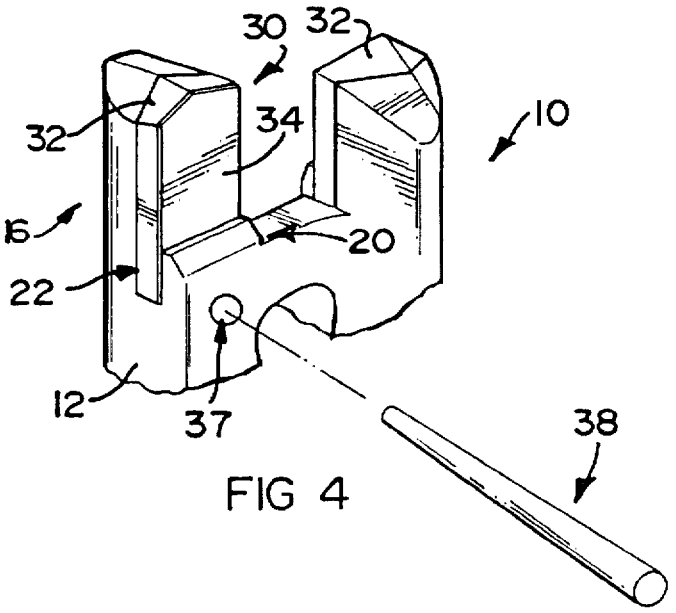
FIG. 4 shows a view corresponding to FIG. 1, but with the tip seated within the borer body.

With reference to FIGS. 1 to 4 of the drawings, a rotary borer body of the kind described is generally indicated by reference numeral 10. It has a shank 12 having drill steel mounting means which can be conventional at a free rear end thereof to mount the body 10 on a drill steel. The body 10 is of generally round shape about a longitudinal or rotary axis 14.

The body 10 is symmetrical about the axis 14 having at a front thereof a pair of diametrically opposed tip mounting means. The tip mounting means are identical and only one is described in detail.

The tip mounting means includes an anvil formation 16 having an anvil surface 18 extending forwardly and facing in a direction in which rotation will take place in use to effect boring. The anvil surface 18 is composite in that it is of generally concave shape, more specifically in the form of an obtuse dihedral such that a longitudinal line 18.3 divides the two surfaces 18.1 and 18.2. Advantageously, the anvil formation 16 is peaked at a free end thereof as shown at 19.

Circumferentially spaced from the anvil formation, there is provided an opposing retaining formation 20 having a retaining surface (obscured in the drawing) facing the anvil surface 18 such that a longitudinally extending slot 22 is provided intermediate the anvil surface 18 and the retaining surface. The retaining surface advantageously lies on a radius The slot 22 is taper as will be described of the body 10. hereinafter.

The anvil formation 16 is robust or rigid having a relatively thick cross section and the retaining formation is relatively resilient having a relatively thin cross section.

A bit or tip 30 is in the process of being received within the slot 22. The tip 30 has a back member 32 and an operative face layer 34 of hard, abrasion resistant material. In a sophisticated, preferred embodiment, the face layer 34 is of polycrystalline diamond material. The face layer 34 is planar and it lies against a planar face of the back 32. An opposed surface of the back 32 is of dihedral shape, complemental to the shape of the anvil surface 18. Along an upper edge of the back 32, it extends the peaked shape 19 of the anvil formation 16, as shown at 36.

The slot 22 is formed to converge or taper at a narrow angle in a direction from an open front end thereof toward its rear or bottom. The tip 30 is correspondingly taper to fit snugly into the slot 22. In the embodiment shown, the angles are equal at about 21.

In use, as boring operations commence, the tip 30 will be urged deeper into its seat to be frictionally located in taper-lock or wedge-lock fashion within its seat. The dihedral shape of the anvil surface 18 and the complemental shape of the back 32 locate the tip 30 within the slot 20.

In use, rotation takes place in a direction such that the tip 30, and more specifically its operative face 34, leads. Thus, the tip 30 is supported by the anvil formation 16.

It is significant that the anvil formation 16 extends relatively far forward to be only a small distance short of the front of the tip 30 thus to support the tip to a position close to its extremity in use. For rotary borers suitable to drill holes between about 20 mm diameter and about 40 mm diameter, the extremity of the anvil formation may be shy of the extremity of the tip by between about 2 mm and about 10 mm, preferably between about 3 mm and about 6 mm, most preferably between about 4 mm and 5 mm.

It is further significant that the retaining formation extends merely to a forwarded position well short of the front of the tip 30, thus leaving a large portion of, in fact a major portion of, the working layer 34 exposed. This ensures that a large working area to cut into a substrate is available which is conducive to a high penetration rate or boring rate in use. Furthermore, it extends the useful life of the tip. This feature is readily apparent from FIG. 4.

When the tip 30 is to be released from the body 10, the anvil formation 16 and retaining formation 20 are heated, more specifically in the vicinity of the anvil surface 18 and the retaining surface. Thermal expansion, concentrated along the anvil surface 18 and the retaining surface, causes the slot 22 to open slightly and thus to enlarge the angle of convergence to release the tip 30.

Instead, if desired, a transverse aperture 37 is provided through the body in a predetermined, exposed, relation to the bottom of the slot 22 to allow a thin end of a taper drift 38 to be inserted underneath the tip 30. By tapping the taper drift 38 into the aperture, frictional locking of the tip is broken by a wedging action to release the tip.

It is a first advantage of the invention, especially in respect of tips which are prone to become worn while the body 10 is still useful, that those tips can easily be replaced by fresh tips in situ. More specifically, in the preferred embodiment, the only infrastructure required to replace such a tip is a source of heat which can be applied in a relatively concentrated fashion.

The Applicant regards an important advantage of the invention to be in relation to highly sophisticated modern tips, especially tips of polycrystalline diamond material. Those tips can last very long, and can outlast a body carrying them. Thus, in those cases, it is desirable to be able to release a tip from a body when the body has become worn and to mount it on a fresh body. In this regard, it is to be appreciated that although the tip is so efficient in cutting that it is cost effective, it is in fact very expensive and it is thus very important to allow it to be used optimally.

Thus, the invention allows such expensive, sophisticated tips of borers in accordance with this invention to be replaced on fresh bodies in situ. In this regard, it is to be appreciated that the conventional practice of transporting borers out of the mine to be refurbished and then to be transported back into the mine, uses substantial transport capacity. This practice can now be ameliorated by using rotary borers in accordance with this invention.

The Applicant further regards it as an important advantage that tips can be mounted and released on borer bodies in a user friendly manner which is also very advantageous in respect of time and expense.

It is yet a further advantage that the mounting means on the body can be produced by precision casting obviating expensive, close tolerance material removing operations. In this regard, it is extremely important to appreciate that the taper-lock or wedge-lock mechanism allows the tip to find its own longitudinal position in the slot, thus obviating close manufacturing tolerances—for example in respect to the width of the slot.

The Applicant regards it as an advantage that the tip is supported along a major portion of its length, advantageously to a position at most a short distance short of its forward extremity, in rigid fashion by means of the rigid anvil manner, yet that some resilience or "give" is provided by the relatively resilient retaining member. The rigid support is expected to ameliorate the strength requirements of the tip, which is an expensive component. The resilience is expected to ameliorate manufacturing tolerances and to enhance frictional retention of the tip in the slot.

Figure 5:
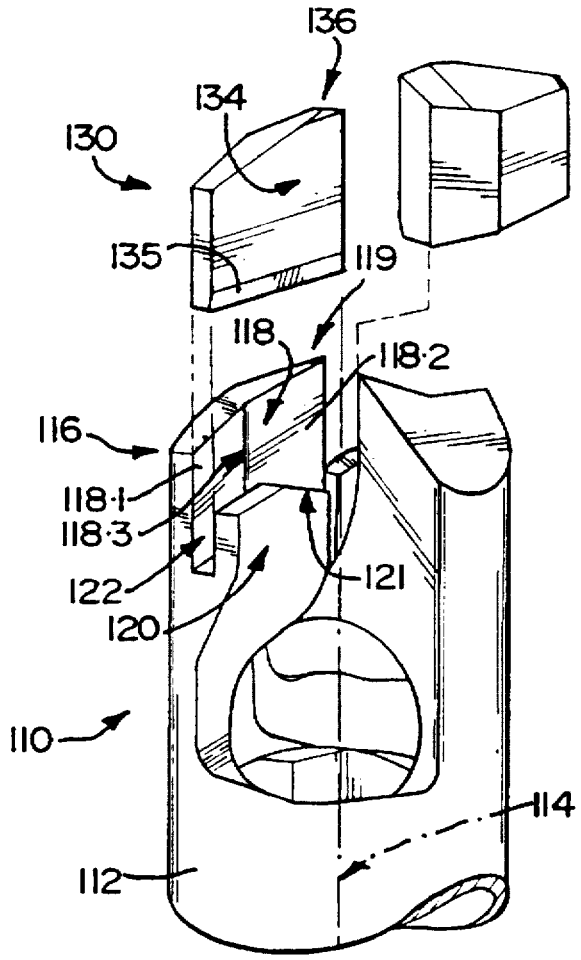
FIG. 5 shows, in a view corresponding to FIG. 1, a second embodiment of a rotary borer in accordance with this invention.

With reference to FIG. 5 of the drawings, a further embodiment of a rotary borer in accordance with the invention is shown having components and features which are very similar to those of the embodiment of FIG. 1. Like reference numerals are used to denote like features and the embodiment is not again described in detail. Differences between the embodiments of FIGS. 1 and 5 will merely be highlighted.

The tips 130 of the embodiment of FIG. 5 have peaks toward their radially inner ends as indicated at 136 which project furthest. Correspondingly, the anvil formations 116 also project furthest at their radially inner ends as indicated by reference numeral 119. The inner longitudinal edges of the tips are closely adjacent each other, but do not touch so as not to transmit forces on account of stress and strain to each other in use.

Conversely, each retaining formation 120 is chamfered at a shallow angle at its radially inner end as indicated by reference numeral 121. This enlarges even further the portion of the working surface 134 of each tip 130 which is exposed in use.

Advantageously, a rearward extremity of the tip is chamfered as shown at 135 at a shallow angle, e.g. about 5°. This facilitates entry of the tip into the slot 122 and prevents it from "digging in" when it is urged deeper into the slot.

The tips 130 are in the form of carbide inserts i.e. they do not have the polycrystalline diamond layer of the tips 30 of FIG. 1.

Figure 6:
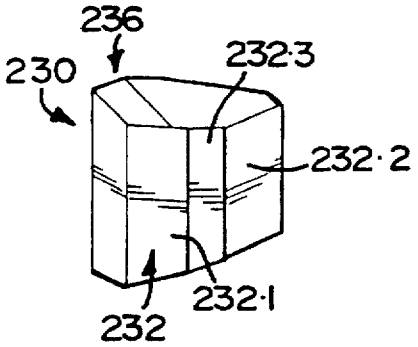
FIGS. 6, 7, and 8 show, respectively in three dimensional side view, in plan view and in plan view, three further embodiments of tips forming part of rotary borers in accordance with the invention.

With reference to FIG. 6, yet a further embodiment of a tip is generally indicated by reference numeral 230. It is similar to the tip 130 of FIG. 5 except that a rear face 232 thereof is shaped in three planes as opposed to the two planes of the FIG. 1 and FIG. 5 embodiments. Thus, between the outer planes 232.1 and 232.2, there is also a central plane 232.3 The Applicant believes that this configuration will enhance seating and thus location of the tip in the seat provided by the anvil surface. It can be visualized readily by a person skilled in the art that the face of the anvil member can be shaped complementally to the shape of the back 232 of the tip 230. Instead, if desired, the face of the anvil member can be similar to the faces 18 and 118 of the anvil members 16 and 116 respectively of FIGS. 1 and 5. In such an embodiment, the flattened portion 232.3 will merely stand slightly proud of the dividing line 18.3, 118.3 of the faces 18, 118. This will alleviate manufacturing tolerances and will even accommodate foreign matter which may have accumulated in the vicinity of the dividing line 18.3, 118.3.

Figure 7:
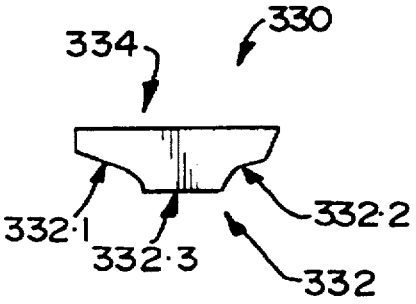

With reference to FIG. 7, yet a further embodiment of a tip is indicated by reference numeral 330. Its back 232 has a planar center portion 332.3 similar to the planar portion 232.3 of the FIG. 6 embodiment. However, the central planar portion 323.3 is flanked by concave surface 332.1 and 332.2. A face of a complemental anvil formation will be shaped complementally, which can easily be visualized by a person skilled in the art. It is expected that the tip 330 will seat particularly snugly and will thus be located particularly well in its anvil formation in use.

Figure 8:
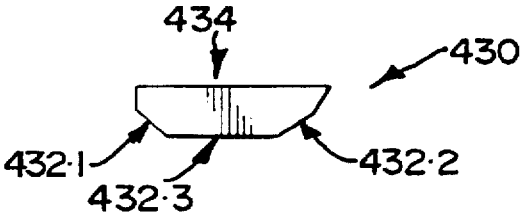

Yet a further embodiment of a tip is generally indicated by reference numeral 430 in FIG. 8. It too has a central planar portion 432.3 generally parallel to the working surface 434. However, it is flanked at either side by generally convex flanks which, in this embodiment, are angular in two steps each i.e. having chamfered portions 432.1 and 432.2 proximate the central planar portion 432.3 and then being chamfered along steeper angles to run out in the working surface 434.

Figure 9:
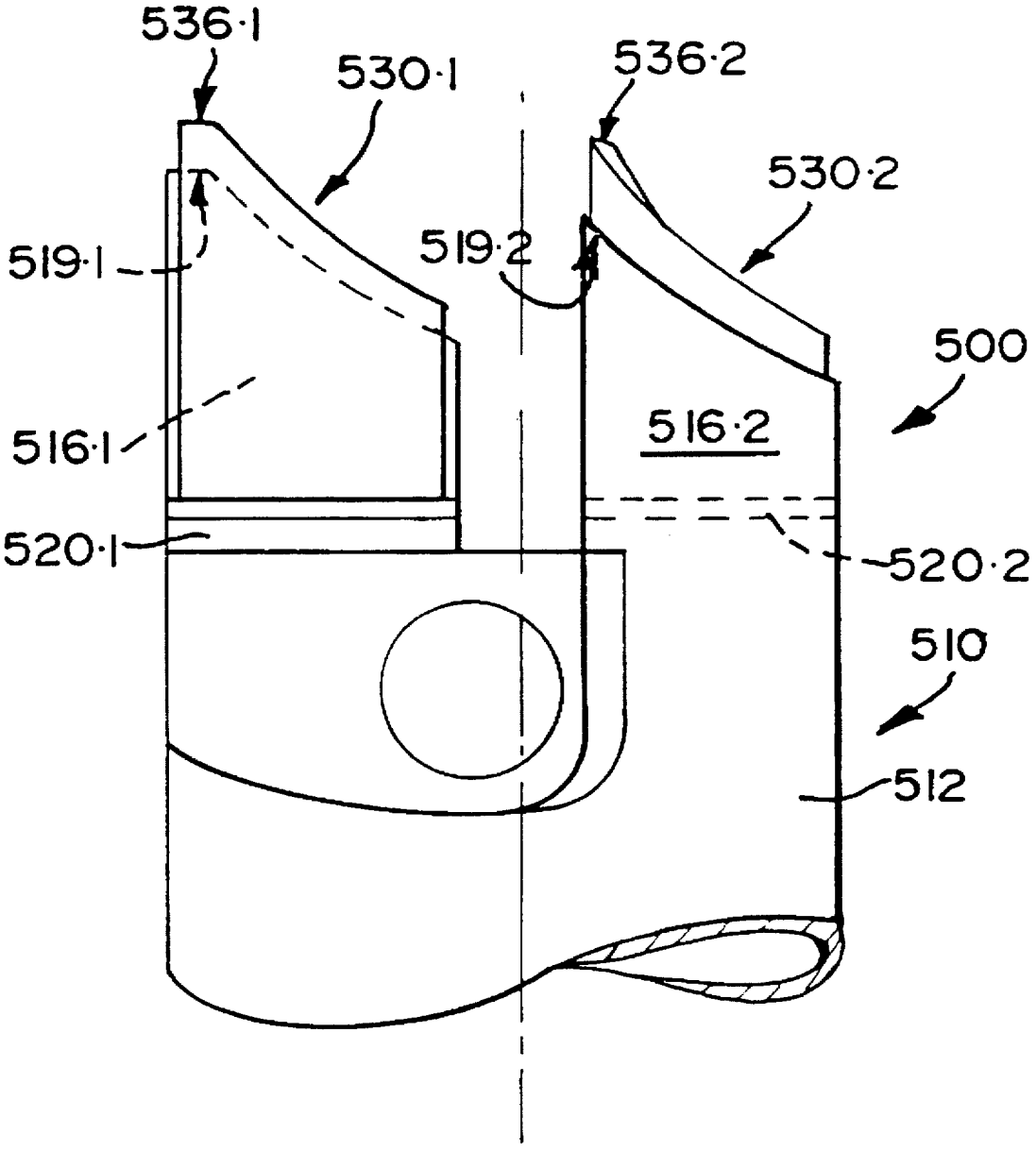
FIG. 9 shows, in side view, a further embodiment of a rotary borer in accordance with this invention.

With reference to FIG. 9 a further embodiment of a rotary borer in accordance with the invention is generally indicated by reference numeral 500. The borer 500 comprises a body generally indicated by reference numeral 510 and two tips of hard abrasion resistant material indicated respectively by reference numerals 530.1 and 530.2.

The components and features of embodiment of FIG. 9 are generally similar to the components of features of the embodiments already described. Like reference numerals are used to indicate like features and components which are not again described in detail. Emphasis is merely placed on a single feature which distinguishes the embodiment of FIG. 9 from the embodiments already described.

The tip 530.1 has a forward peak or extremity as indicated by reference numeral 536.1 toward a radially outer end. Thus, the peak or extremity 536.1 will in use lead the cutting action in the radially outer regions of a hole being bored.

In contra distinction, the tip 530.2 has a forward peak or extremity 536.2 toward a radially inner end. Thus, the peak or extremity 536.2 will lead the cutting action in the radially inner regions of the hole being bored in use. The peaks or extremities 536.1 and 536.2 are generally at the same longitudinal position.

The Applicant regards it as an advantage of the embodiment of FIG. 9 that it will act in the manner of a "core cutter". Thus, cutting does not take place to the same depth along the whole extent of the hole being bored, but is concentrated along a respectively radially outer and a respectively radially inner cutting circle thus ameliorating the boring torque required and thus also the stress on the tip and the body formations supporting the tips.

It is to be appreciated, in respect of all of the embodiments of FIG. 5 and further, that the slots in the bodies taper rearwardly at a small angle, that the tips taper rearwardly complementally and that receipt of the tips in the slots in each case is frictionally in wedge lock fashion as described in detail with reference to the FIG. 1 embodiment.

The embodiments of FIG. 5 and further generally have the same advantages described in more detail with reference to the FIG. 1 embodiment.

What is claimed is:

1. A rotary borer including a body which is generally round having a rotation axis, a front and a rear, the body comprising drill steel mounting means for releasably mounting the borer on a drill steel to be rotated in a predetermined rotary direction about the rotation axis in use, and tip mounting means including an anvil formation defining a forwardly extending anvil surface and an opposing retaining formation defining a forwardly extending retaining surface, the anvil surface and retaining surface being forwardly diverging to form between them a correspondingly forwardly extending slot which slot tapers rearwardly at an angle smaller than about 5°; and a tip of hard, abrasion-resistant material having a front, a rear and sides tapering toward the rear at an angle which is complemental to the angle of the slot, the tip being operatively received in the slot such that pressure on the tip during boring, in a longitudinal direction opposite to the direction in which boring advances, wedges the tip into the slot to cause frictional retention of the tip in the slot, wherein the anvil surface, relative to the predetermined direction of rotation in use, is arranged to trail the tip, the anvil surface having a non-planar seat to seat the tip which has a complemental seat formation, the anvil surface extending forwardly to a position at most a small distance short of the forward extremity of the tip to support the tip along a major portion of its length, the retaining formation terminating longitudinally short of the forward extremity of the anvil surface and well short of the forward extremity of the tip to leave a relatively large portion of the tip toward its front exposed.

2. A rotary borer as claimed in claim 1 in which said tip mounting means is first tip mounting means disposed generally radially toward one side of the rotary axis and in which said tip is a first tip, the borer including second tip mounting means circumferentially spaced from the first tip mounting means, and a second tip similarly received in the second tip mounting means.

3. A rotary borer as claimed in claim 2 in which the first and second tips are radially aligned.

4. A rotary borer as claimed in claim 2 which is symmetrical around the rotation axis.

5. A rotary borer as claimed in claim 4 in which the first and second tip mounting means are identical and in which the first and second tips are identical.

6. A rotary borer as claimed in claim 2 in which the tips have peaks or forward extremities toward their radially inner ends.

7. A rotary borer as claimed in claim 2 in which the first tip has a peak or forward extremity toward a radially inner end and the second tip has a peak or forward extremity toward a radially outer end.

8. A rotary borer as claimed in claim 1 which has an aperture through the body which aperture is transverse to the slot and open to a rear or bottom of the slot such as to allow a thin end of a taper drift to be inserted underneath a rear end of the tip and to wedge the tip out of the slot by progressive penetration of the taper drift into the aperture.

9. In a rotary borer including a body which is generally round having a rotation axis, a front and a rear, the body comprising drill steel mounting means for releasably mounting the borer on a drill steel to be rotated in a predetermined rotary direction about the rotation axis in use, and tip mounting means including an anvil formation defining a forwardly extending anvil surface and an opposing retaining formation defining a forwardly extending retaining surface, the anvil surface and retaining surface being forwardly diverging to form between them a correspondingly forwardly extending slot which slot tapers rearwardly at an angle smaller than about 5°; and a tip of hard, abrasion-resistant material having a front, a rear and sides tapering toward the rear at an angle which is complemental to the angle of the slot, the tip being operatively received in the slot such that pressure on the tip during boring, in a longitudinal direction opposite to the direction in which boring advances, wedges the tip into the slot to cause frictional retention of the tip in the slot, wherein, relative to the predetermined direction of rotation in use, the anvil surface is arranged to trail the tip, and the retaining surface is arranged to lead the tip, and wherein one of the anvil surface and the retaining surface has a non-planar seat to seat the tip which has a complemental seat formation, the method including applying heat to the retaining surface to cause the retaining formation to deform to open the slot.

10. A rotary borer including a body which is generally round having a rotation axis, a front and a rear, the body comprising drill steel mounting means for releasably mounting the borer on a drill steel to be rotated in a predetermined rotary direction about the rotation axis in use, and tip mounting means including an anvil formation defining a forwardly extending anvil surface and an opposing retaining formation defining a forwardly extending retaining surface, the anvil surface and retaining surface being forwardly diverging to form between them a correspondingly forwardly extending slot which slot tapers rearwardly at an angle smaller than about 5°; and a tip of hard, abrasion-resistant material having a front, a rear and sides tapering toward the rear at an angle which is complemental to the angle of the slot, the tip being operatively received in the slot such that pressure on the tip during boring, in a longitudinal direction opposite to the direction in which boring advances, wedges the tip into the slot to cause frictional retention of the tip in the slot, wherein the anvil surface, relative to the predetermined direction of rotation in use, is arranged to trail the tip, one of the anvil surface and the retaining surface having a non-planar seat to seat the tip which has a complemental seat formation, in which the anvil formation has a relatively thick cross section and is correspondingly relatively rigid and the retaining formation has a relatively thin cross section and is correspondingly relatively resilient.

* * * * *